US006400072B1

(12) United States Patent
O'Rourke et al.

(10) Patent No.: US 6,400,072 B1
(45) Date of Patent: Jun. 4, 2002

(54) VIEWING SCREEN FOR A DISPLAY DEVICE

(75) Inventors: Shawn M. O'Rourke, Tempe; Nick R. Munizza, Gilbert; Matthew Stainer, Phoenix, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/520,911

(22) Filed: Mar. 8, 2000

(51) Int. Cl.[7] ..... H01J 29/10
(52) U.S. Cl. ..... 313/461; 313/473
(58) Field of Search ..... 313/461, 466, 313/473, 495

(56) References Cited

U.S. PATENT DOCUMENTS 5,945,780 A 8/1999 Ingle et al.

*Primary Examiner*—Vip Patel

(74) *Attorney, Agent, or Firm*—Kevin D. Wills; William E. Koch

(57) ABSTRACT

A viewing screen (100) for a display device (115) includes a glass substrate (110) having a thermal coefficient of expansion within a range of $3.5\times10^{-6}$–$4.5\times10^{-6}$ °C.$^{-1}$. Viewing screen (100) further includes a black matrix (111), which is affixed to glass substrate (110), and which includes a black surround, a ductile metal, and lead titanate.

A method for fabricating viewing screen (100) includes the steps of: adding to a black surround paste a ductile metal paste, adding to the black surround paste lead titanate particles, depositing the black surround paste on glass substrate (110), and heating the black surround paste and glass substrate (110) to affix the black surround paste to glass substrate (110), thereby forming black matrix (111). The ductile metal paste and lead titanate particles are added in amounts sufficient to realize an extent of cracking in black matrix (111) upon repeated heating to a temperature within a range of 450–600° C. that is significantly less than that exhibited by an unimproved black matrix, which is made only from the material of the black surround paste.

11 Claims, 1 Drawing Sheet

VIEWING SCREEN FOR A DISPLAY DEVICE

FIELD OF THE INVENTION

The present invention pertains to the area of viewing screens and methods for fabricating viewing screens for display devices and, more particularly, to a viewing screen for a field emission display and method for the fabrication thereof.

BACKGROUND OF THE INVENTION

Methods for fabricating viewing screens having black surround on a glass substrate are known in the art. It is known in the art to fabricate a black surround material using glass binders and pigments. These materials are known to have linear thermal expansion coefficients within a range of about $10\times10^{-6}$ to $12\times10^{-6}$° C.$^{-1}$. The prior art black surround materials are adequate for the combinations of temperature and type of glass substrate utilized in prior art methods for fabricating viewing screens. For example, prior art methods typically expose the black surround and the glass substrate to temperatures of up to 550° C.

However, it may be desirable to utilize higher temperatures, at which the prior art combinations of black surround and glass substrate may be inadequate. For example, it is believed to be desirable in the fabrication of field mission displays to utilize process temperatures up to about 600° C. First, the glass substrate must be able to withstand. such temperatures. Furthermore, the black surround-substrate interface must not crack during the heat treatments.

However, prior art viewing screens may not be adequate for repeated high temperature treatments. For example, they may have temperature tolerances that are less than these higher temperatures. Soda lime silicate is a typical glass substrate, which can tolerate temperatures up to only 540° C. Furthermore, even if the glass can withstand the higher temperature, a mismatch of the thermal expansion coefficients of the black surround material and the glass substrate can undesirably result in the cracking of the black surround-substrate interface.

For example, it is known to use borosilicate glass for the glass substrate in field emission displays. It is believed to be desirable to increase processing temperatures up to about 600° C. Borosilicate glass can withstand these higher processing temperatures. However, borosilicate glass has a thermal expansion coefficient equal to about $4\times10^{-6}$° C.$^{-1}$, which is appreciably less than that of the standard thick-film black surround. Thus, if the standard thick-film black surround is used on the borosilicate glass, the black surround-substrate interface cracks during high temperature thermal cycling.

Accordingly, there exists a need for an improved method for fabricating a viewing screen for a display device, which provides a viewing screen that maintains its physical integrity at temperatures up to at least 550° C.

Figure 1:
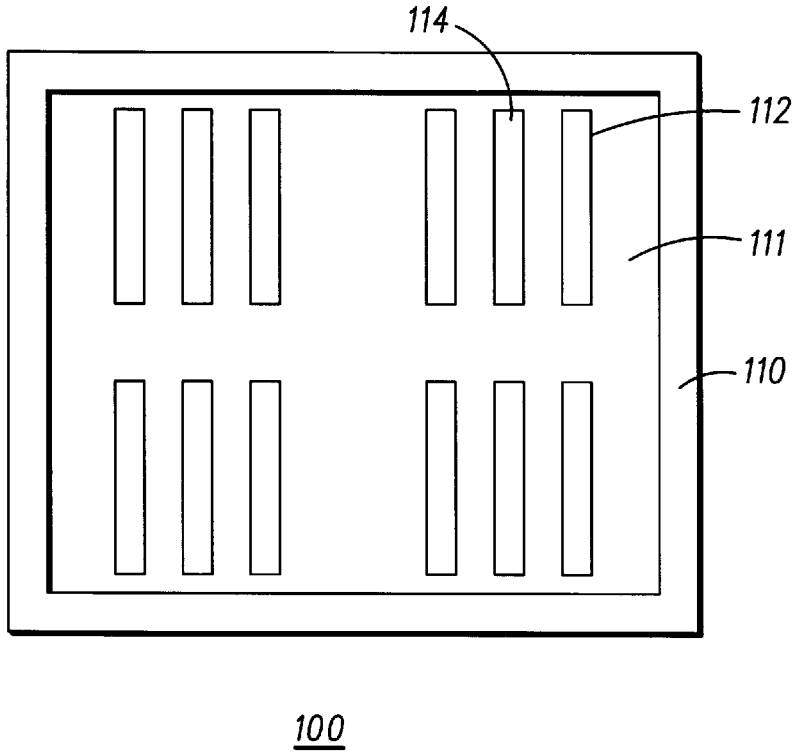
FIG. 1 is a bottom plan view of a preferred embodiment of a viewing screen fabricated in accordance with the method of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a viewing screen for a display device. The viewing screen of the invention has a black matrix, which includes a black surround, a ductile metal, and lead titanate. The black matrix is affixed to a glass substrate that has a thermal coefficient of expansion within a range of $3.5\times10^{-6}$–$4.5\times10^{-6}$° C.$^{-1}$. One benefit of the viewing screen of the invention is the occurrence of little or no cracking of the black matrix during repeated thermal treatments of the viewing screen at temperatures less than about 600° C. This benefit is realized by the method of the invention for fabricating a viewing screen, which includes the step of adding to a black surround paste a ductile metal paste and lead titanate particles.

FIG. 1 is a bottom plan view of a preferred embodiment of a viewing screen 100 fabricated in accordance with the method of the invention. Viewing screen 100 includes a glass substrate 110 and a black matrix 111, which is affixed to glass substrate 110. Black matrix 111 preferably has a thickness within a range of 2–6 micrometers. Black matrix 111 further defines phosphor vias 112. A cathodoluminescent phosphor 114 is disposed in each of phosphor vias 112.

In accordance with the invention, glass substrate 110 preferably has a thermal coefficient of expansion within a range of $3.5\times10^{-6}$–$4.5\times10^{-6}$° C.$^{-1}$. Borosilicate and aluminosilicate glasses exhibit thermal expansion coefficients within this range.

In accordance with the invention, black matrix 111 includes a black surround, a ductile metal, and lead titanate. The concentration of the ductile metal is sufficient to provide elastic and non-elastic stress relief within black matrix 111, and the concentration of lead titanate is sufficient to control crack propagation in black matrix 111. Preferably, the concentration of the ductile metal is sufficient to provide elastic and non-elastic stress relief within black matrix 111 upon repeated heating to a temperature within a range of about 450–600° C. and the concentration of lead titanate is sufficient to control crack propagation in black matrix 111 upon repeated heating to a temperature within a range of about 450–600° C.

The black surround of black matrix 111 is preferably made up of about 10 wt % ruthenium oxide and about 90 wt % a glass. The glass of the black surround most preferably has a firing temperature that is less than 600° C. so that firing occurs at a temperature below the critical temperature of glass substrate 110. Preferably, the glass of the black surround is a low melting point solder glass composed primarily of lead oxide, bismuth trioxide, and silica. Most preferably, the glass of the black surround has about 87.5 wt % lead oxide, about 12.5 wt % bismuth trioxide, and trace silica.

The ductile metal of black matrix 111 is preferably silver. Gold can alternatively be employed for the ductile metal component.

An exemplary final composition of black matrix 111 is: about 7.1 wt % ruthenium oxide, about 21.4 wt % silver, about 4.8 wt % lead titanate, and about 66.7 wt % glass.

A method for fabricating viewing screen 100 in accordance with the invention includes the steps of providing a black surround paste, adding to the black surround paste a ductile metal paste, and adding to the black surround paste lead titanate particles. In general, the amount of ductile metal paste is sufficient to realize elastic and non-elastic stress relief within black matrix 111, and the amount of lead titanate particles is sufficient to control the propagation of cracks in black matrix 111.

The black surround paste has a vitreous solder glass, a pigment, a solvent, and a binder. Preferably, the black surround paste has greater than 50 wt % vitreous solder glass, 5–30 wt % pigment, 10–35 wt % solvent, and 5–30 wt % binder. Most preferably, the black surround paste has about 54 wt % vitreous solder glass, about 6 wt % pigment, within 30–35 wt % solvent, and within 5–10 wt % binder.

The vitreous solder glass preferably has a firing temperature equal to less than 600° C. Preferably, the glass is a low melting point solder glass composed primarily of lead oxide, bismuth trioxide, and silica. A preferred vitreous solder glass for the black surround paste has about 85–90 wt % lead oxide, about 10–15 wt % bismuth trioxide, and trace-5 wt % silica. Most preferably, the vitreous solder glass for the black surround paste has about 87.5 wt % lead oxide, about 12.5 wt % bismuth trioxide, and trace silica.

An exemplary pigment for use in the black surround paste is ruthenium oxide. Exemplary solvents for use in the black surround paste are alpha terpineol, butyl carbitol acetate, trimethylpentanediol monoisobutyrate, and the like. Exemplary binders for use in the black surround paste are acrylic resin, ethyl cellulose, and the like.

The ductile metal paste preferably has greater than 50 wt % ductile metal, 10–35 wt % solvent, 5–30 wt % binder, and 1–10 wt % glass. Most preferably, the ductile metal paste has 51–54 wt % ductile metal, 30–35 wt % solvent, 5–10 wt % binder, and 6–9 wt % glass. Preferably, the step of adding to the black surround paste a ductile metal paste includes the step of adding to the black surround paste a silver metal paste. Alternatively, a gold metal paste can be used. Exemplary solvents for use in the ductile metal paste are alpha terpineol, butyl carbitol acetate, trimethylpentanediol monoisobutyrate, and the like. Exemplary binders for use in the ductile metal paste are acrylic resin, ethyl cellulose, and the like. The glass of the ductile metal paste is a low melting point solder glass composed primarily of lead oxide, bismuth trioxide, and silica. For example, the glass of the ductile metal paste can have about 87.5 wt % lead oxide, about 12.5 wt % bismuth trioxide, and trace silica.

Preferably, the amount of ductile metal paste added to the black surround paste is selected such that, if viewing screen 100 were repeatedly heated from room temperature (about 25° C.) to a temperature within a range of about 450–600° C. and then cooled naturally, elastic and non-elastic stress relief within black matrix 111 would be realized.

The step of adding to the black surround paste lead titanate particles preferably includes the step of adding to the black surround paste lead titanate particles having a mean particle diameter equal to about 1 micrometer. Furthermore, the amount of lead titanate particles is preferably selected such that, if viewing screen 100 were repeatedly heated from room temperature to a temperature within a range of about 450–600° C. and then cooled naturally, control of the propagation of cracks in black matrix 111 would be realized.

After the addition to the black surround paste of the ductile metal paste and the lead titanate particles, the black surround paste is deposited on glass substrate 110, which is then patterned and heated to a temperature and for a duration sufficient to affix the black surround paste to glass substrate 110.

Another method for fabricating a viewing screen for a display device in accordance with the invention includes the step of adding to the black surround paste a ductile metal paste, such that the black surround paste has a weight within a range of 75–85% of the combined weight of the black surround paste and the ductile metal paste. The ductile metal paste has a weight within a range of 15–25% of the combined weight of the black surround paste and the ductile metal paste. This method further includes the step of adding to the black surround paste lead titanate particles having a weight within a range of 1–5% of the combined weight of the black surround paste and the ductile metal paste.

Yet another method for fabricating a viewing screen for a display device in accordance with the invention includes the step of adding to a black surround paste a ductile metal paste and lead titanate particles, wherein the ductile metal paste and lead titanate particles are provided in amounts sufficient to realize an extent of cracking in black matrix 111 upon repeatedly heating to a temperature within a range of about 450–600° C. that is at least 95% less than the extent of cracking exhibited by an unimproved black matrix upon repeatedly heating to a temperature within a range of about 450–600° C. The unimproved black matrix is made only from the material of the black surround paste; its fabrication does not include the steps of adding a ductile metal paste or adding lead titanate particles to the black surround paste. The unimproved black matrix has a thickness equal to the thickness of black matrix 111.

For example, a viewing screen was fabricated, wherein the black surround paste included 54 wt % vitreous solder glass, 6 wt % ruthenium oxide pigment, 30 wt % trimethylpentanediol monoisobutyrate solvent, and 10 wt % acrylic resin binder. The vitreous solder glass included about 87.5 wt % lead oxide, about 12.5 wt % bismuth trioxide, and trace silica. The ductile metal paste was a silver metal paste having 54 wt % silver, 6 wt % vitreous solder glass, 5 wt % acrylic resin binder, and 35 wt % trimethylpentanediol monoisobutyrate. The combination of the black surround paste and ductile metal paste included 75 wt % black surround paste and 25 wt % silver metal paste. The weight of the lead titanate particles was equal to 5% of the combined weight of the black surround paste and ductile metal paste. An additional amount of trimethylpentanediol monoisobutyrate solvent was added to the mixture of the black surround paste and silver metal paste. The weight of the additional solvent was equal to about 10% of the combined weight of the black surround paste and the ductile metal paste. The black surround paste was batched, mixed using an ultrasonic horn, and allowed to roll for about 24 hours. Then, the black surround paste was deposited by screen printing on a substrate made from aluminosilicate glass. The film was patterned to form the phosphor vias. Thereafter, the black surround paste and glass substrate were heated at a temperature of about 520° C. for 55 minutes, thereby affixing the black surround paste to the glass substrate, and then allowed to cool naturally.

For comparison purposes, an unimproved black matrix was formed on an aluminosilicate glass substrate. The unimproved black matrix was made by depositing on the substrate a film of the black surround paste, which included 54 wt % vitreous solder glass, 6 wt % ruthenium oxide pigment, 30 wt % trimethylpentanediol monoisobutyrate solvent, and 10 wt % acrylic resin binder. The vitreous solder glass included about 87.5 wt % lead oxide, about 12.5 wt % bismuth trioxide, and trace silica. The method for making the unimproved black matrix did not include the steps of adding a ductile metal paste or adding lead titanate particles to the black surround paste. The thickness of the deposited film was made equal to the thickness of the film used to make the black matrix of the invention. The glass substrate having the film of the black surround paste was heated at 520° C. for 55 minutes and then allowed to cool naturally.

To compare the extent of cracking, the viewing screen made in accordance with the invention was heated to 450° C. for 55 minutes and then allowed to cool naturally to room temperature. This firing cycle was repeated two more times. The viewing screen having the unimproved black matrix was similarly heated to 450° C. for 55 minutes and then allowed to cool naturally to room temperature. Only one firing cycle was performed on the unimproved viewing screen. Visual inspection of the black matrices using an optical microscope at 75× magnification revealed prolific cracking and peeling in the unimproved black matrix, whereas the black matrix that was made in accordance with the invention exhibited only nominal cracking.

Figure 2:
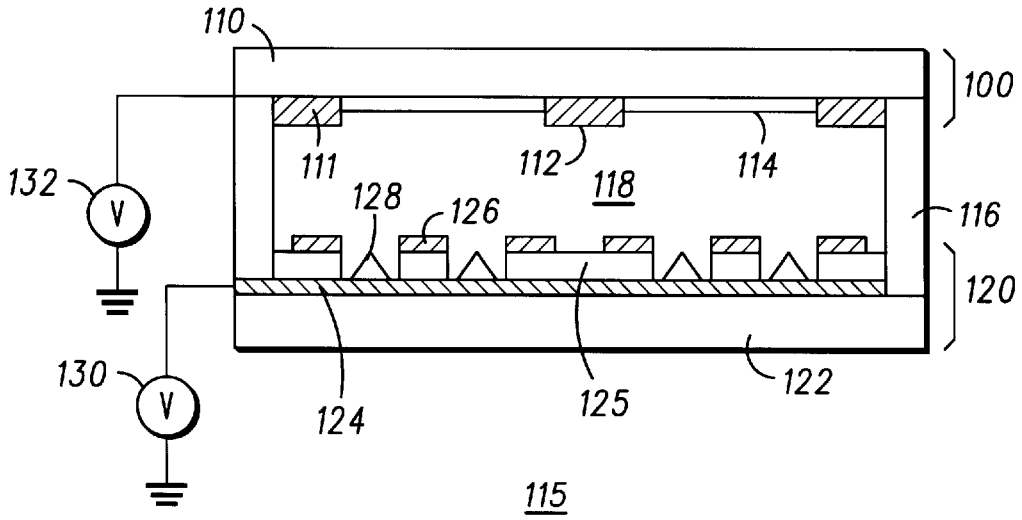
FIG. 2 is a cross-sectional view of a preferred embodiment of a display device having the viewing screen of FIG. 1, in accordance with the invention.

FIG. 2 is a cross-sectional view of a preferred embodiment of a display device 115 having viewing screen 100 of FIG. 1, in accordance with the invention. In the preferred embodiment of FIG. 2, display device 115 is a field emission display. Display device 115 includes a cathode plate 120, which opposes viewing screen 100.

Cathode plate 120 includes a substrate 122, which can be made from glass, silicon, and the like. A cathode 124 is disposed upon substrate 122. Cathode 124 is connected to a first voltage source 130. A dielectric layer 125 is disposed upon cathode 124, and further defines a plurality of emitter wells, each of which contains an electron emitter 128.

The display device described herein is directed to a field emission display device employing Spindt tip emitter structures. However, the scope of the invention is not intended to be limited to field emission display devices or to devices having Spindt tip emitter structures. The invention can be embodied by a viewing screen and display device that employ an electron source and a cathodoluminescent phosphor for generating the display image. For example, the invention can be embodied by a cathode ray tube display device. Also, in a field emission display device, the electron emitter structure can be a structure other than a Spindt tip, such as an edge emitter, wedge emitter, or surface emitter.

As further illustrated in FIG. 2, cathode plate 120 includes a gate electrode 126, which is disposed on dielectric layer 125 and is connected to a second voltage source (not shown). Application of selected potentials to cathode 124 and gate electrode 126 cause electron emitters 128 to emit electrons for activating phosphors 114.

Viewing screen 100 is spaced apart from cathode plate 120 by a frame 116 to define an interspace region 118. The fabrication of display device 115 includes the step of affixing viewing screen 100 to frame 116. The affixant can be a glass frit, which requires a sealing temperature of about 450° C. The beneficial properties of viewing screen 100 allow it to be heated to this sealing temperature without creating cracks in black matrix 111.

During the operation of display device 115, a potential is applied to phosphors 114 for attracting thereto electrons emitted by electron emitters 128. A third voltage source 132 is connected to viewing screen 100 for providing this anode potential.

In summary, the invention is for a viewing screen for a display device. The viewing screen of the invention is a combination of a black matrix, which includes a black surround, a ductile metal, and lead titanate, and a glass substrate, which has a thermal coefficient of expansion within a range of $3.5\times10^{-6}$–$4.5\times10^{-6}$° C.$^{-1}$. The viewing screen of the invention can be repeatedly heated to a temperature within a range of about 450–600° C. and thereafter cooled without cracking the black matrix. The method of the invention for fabricating the viewing screen includes the steps of adding to a black surround paste a ductile metal paste and adding to the black surround paste lead titanate particles in amounts sufficient to realize the beneficial cracking properties of the viewing screen of the invention.

While we have shown and described specific embodiments of the present invention, further modifications and improvements will occur to those skilled in the art. For example, the invention is embodied by a viewing screen that includes phosphors, which are activated by ultraviolet light, rather than electrons. We desire it to be understood, therefore, that this invention is not limited to the particular forms shown, and we intend in the appended claims to cover all modifications that do not depart from the spirit and scope of this invention.

We claim:

1. A viewing screen for a display device, the viewing screen comprising:

a glass substrate; and a black matrix affixed to the glass substrate and including a black surround, a ductile metal, and lead titanate, wherein the concentration of the ductile metal is sufficient to provide elastic and non-elastic stress relief within the black matrix, and wherein the concentration of lead titanate is sufficient to control crack propagation in the black matrix.

2. The viewing screen as claimed in claim 1, wherein the glass substrate has a thermal coefficient of expansion within a range of $3.5\times10^{-6}4.5\times10^{-6}$ °C.$^{-1}$.

3. The viewing screen as claimed in claim 1, wherein the glass substrate comprises borosilicate glass.

4. The viewing screen as claimed in claim 1, wherein the glass substrate comprises aluminosilicate glass.

5. The viewing screen as claimed in claim 1, wherein the ductile metal comprises silver.

6. The viewing screen as claimed in claim 1, wherein the black surround comprises about 10 wt % ruthenium oxide and about 90 wt % a glass.

7. The viewing screen as claimed in claim 6, wherein the glass comprises a glass having a firing temperature equal to less than 600° C.

8. The viewing screen as claimed in claim 6, wherein the glass comprises about 87.5 wt % lead oxide, about 12.5 wt % bismuth trioxide, and trace silica.

9. The viewing screen as claimed in claim 1, wherein the black matrix has a thickness within a range of 2–6 micrometers.

10. The viewing screen as claimed in claim 1, wherein the concentration of the ductile metal is sufficient to provide elastic and non-elastic stress relief within the black matrix upon repeated heating to a temperature within a range of about 450–600° C. and wherein the concentration of lead titanate is sufficient to control crack propagation in the black matrix upon repeated heating to a temperature within a range of about 450–600° C.

11. A viewing screen for a display device, the viewing screen comprising:

a glass substrate; and a black matrix affixed to the glass substrate and including about 7.1 wt % ruthenium oxide, about 21.4 wt % silver, about 4.8 wt % lead titanate, and about 66.7 wt % glass.

* * * * *